US008217580B2

(12) United States Patent
Grimm et al.

(10) Patent No.: US 8,217,580 B2
(45) Date of Patent: Jul. 10, 2012

(54) FLASHLIGHT FOR ALARM SYSTEMS

(75) Inventors: Max Grimm, Oetwil am See (CH); Kurt Müller, Männedorf (CH); Antonio Pedrosa, Meilen (CH); Hansjürg Wälti, Männedorf (CH)

(73) Assignee: Siemens Aktiengesellschaft, Munich (DE)

( * ) Notice: Subject to any disclaimer, the term of this patent is extended or adjusted under 35 U.S.C. 154(b) by 112 days.

(21) Appl. No.: 12/666,906

(22) PCT Filed: Jun. 13, 2008

(86) PCT No.: PCT/EP2008/057495

§ 371 (c)(1),
(2), (4) Date: Jun. 25, 2010

(87) PCT Pub. No.: WO2009/000681

PCT Pub. Date: Dec. 31, 2008

(65) Prior Publication Data

US 2010/0264840 A1 Oct. 21, 2010

(30) Foreign Application Priority Data

Jun. 28, 2007 (EP) ..... 07111333

(51) Int. Cl.
*H01J 1/60* (2006.01)

(52) U.S. Cl. ..... 315/129; 315/200 A; 315/287

(58) Field of Classification Search ..... 315/129–136, 315/224, 250, 287, 291, 297, 307, 200 A
See application file for complete search history.

(56) References Cited

U.S. PATENT DOCUMENTS

| | | | | |
|---|---|---|---|---|
| 3,925,704 | A * | 12/1975 | Camic | 315/200 A |
| 4,271,408 | A | 6/1981 | Teshima et al. | |
| 4,306,176 | A * | 12/1981 | Kaneko et al. | 315/133 |
| 5,422,543 | A * | 6/1995 | Weinberg | 315/129 |
| 5,936,599 | A | 8/1999 | Reymond | |
| 7,948,468 | B2 * | 5/2011 | Zane et al. | 345/102 |
| 2006/0231745 | A1 * | 10/2006 | Bodano et al. | 250/214 R |

FOREIGN PATENT DOCUMENTS

| | | |
|---|---|---|
| DE | 2941634 A1 | 4/1980 |
| JP | 2000162677 A | 6/2000 |

OTHER PUBLICATIONS

National Semiconductor: "LM2754 800mA Switched Capacitor Flash Drive LED Driver with Time-Out Protection", Sites 1, 4, XP-002502128, pp. 1-11, 2006.
National Semiconductor: "LM3590 Series White LED Drive", Sites 1,4, XP-002502129, pp. 1-9, 2003.

* cited by examiner

*Primary Examiner* — Tung X Le
(74) *Attorney, Agent, or Firm* — Laurence A. Greenberg; Werner H. Stemer; Ralph E. Locher

(57) ABSTRACT

A flashlight for alarm systems includes a light source containing at least one light emitting diode and a circuit which controls said light source. The circuit has a feed supply, a current converter, and flash control device. The current converter, the light source, and the flash control device are connected in series. The current converter includes a control unit, an inductor, an induction stop, and a resistor which are connected in series. The flash control device includes at least one switch for actuating the light source and a microprocessor for controlling the at least one switch.

7 Claims, 1 Drawing Sheet

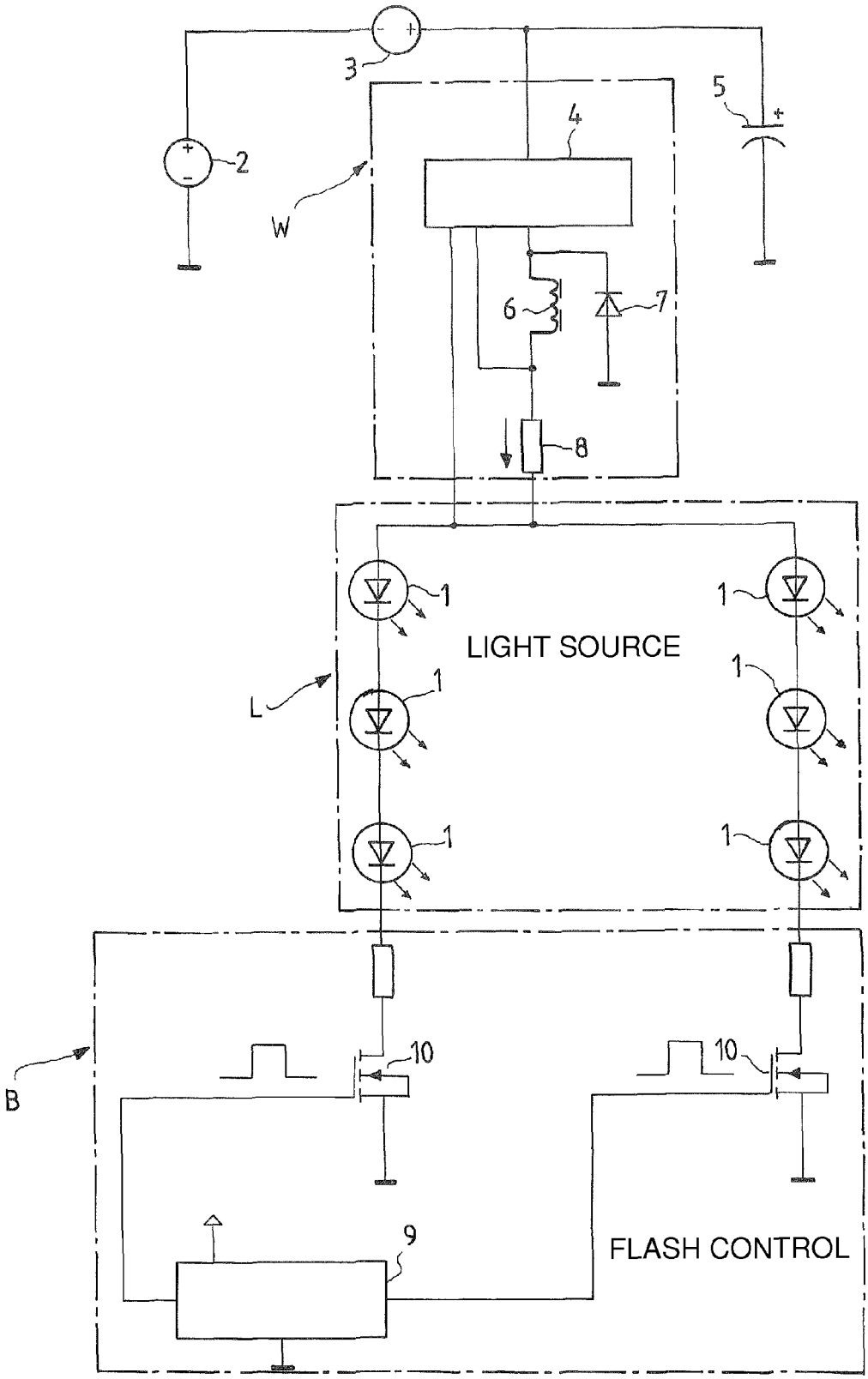
3
2
5
4
W
6
7
8
1
LIGHT SOURCE
L
10
B
9
FLASH CONTROL

FLASHLIGHT FOR ALARM SYSTEMS

BACKGROUND OF THE INVENTION

Field of the Invention:

The present invention relates to a flashing light for alarm systems comprising a light source containing at least one light emitting diode and a circuit which controls said light source, said circuit comprising a feed supply and a flash control device.

Flashing lights of this type are disposed, together with the danger warning device, on the message bus of the alarm system, for instance together with the fire alarms on the message bus of a fire alarm system. Known flashing lights have a relatively high current consumption of approximately 10 times that of a scattered-light smoke detector. It would therefore be advantageous to use flashing lights with as minimal current consumption as possible with a specifically effective light intensity. It is obvious that the effective light intensity is not permitted to fall below a certain lower limit because when the flashing lights are installed in long corridors for instance, this is frequently seen at a shallow angle so that the light intensity perceived by the eye can be very minimal.

The invention is now to specify a flashing light of the type cited in the introduction, said flashing light comprising as minimal a power requirement as possible and thus an improved degree of efficiency.

BRIEF SUMMARY OF THE INVENTION

This object is achieved in accordance with the invention in that the flashing light comprises an current converter which is connected in series with the light source and the flash control device.

With the inventive flashing light, the converter current therefore flows through the light emitting diode, which is very important, because the current consumption is reduced as a result. One further advantage of the inventive solution lies in the degree of efficiency being improved by approximately factor 2 and the current and thus the light emission of the flashing light being kept at a relatively good constant level above a large voltage range of approximately 12 to 30 V.

A first preferred embodiment of the inventive flashing light is characterized in that the current converter has a control unit and that this is connected in series with an inductor, an induction stop and a resistor. The resistor, in conjunction with the control unit, preferably keeps the current for the light source constant during the luminous duration.

Further advantageous embodiments of the inventive flashing light are claimed in additional dependent claims.

BRIEF DESCRIPTION OF THE DRAWING

The invention is described in more detail below with reference to an exemplary embodiment and the only FIGURE in the drawing, which indicates a block diagram of an inventive flashing light.

DESCRIPTION OF THE INVENTION

The FIGURE shows a central part with a light source L containing six light emitting diodes (LEDs) 1, in the upper half the feed supply thereof and a current converter W (inductive down converter) and in the lower part the electronic controller of the light source L designated as flash control device B. As per the representation, the six light emitting diodes 1 forming the light source L are arranged in two parallel branches relative to three light-emitting diodes 1 in each instance. Flashing lights of the described type are often used in combination with an acoustic alarm sensor, with such a combined acoustic/optical alarm sensor being referred to as "sounder beacon", or in German "Blitzsummer". The flashing light or the sounder beacon is preferably mounted on the ceiling and takes a similar form to the fire alarm. Due to the shape and mechanical structure of the flashing light or a suitable sounder beacon, reference is made to the EP application 07105779.8 from the applicant of the present patent application, in which the mechanical structure of the flashing light is described in detail. More than two parallel branches with light-emitting diodes 1 could naturally also be provided.

The feed supply contains a voltage source 2, which provides a voltage of 12 and 30 V for instance and a current limiter 3 for limiting the current supplied by the voltage source 2 to 3 mA. Reference character 5 refers to a storage battery formed by a condenser. The current converter W contains a control unit 4, an inductor 6, a diode 7 acting as an induction stop for the inductor 6 and a resistor 8 acting as a current limiter, at the output of which is disposed the light source L. The control unit 4, the inductor 6, the diode 7 and the resistor 8 are connected in series.

The resistor 8 keeps the current flowing to the light source L during the luminous duration constant at a specific value of 280 mA for instance. Once this value is reached, the current supply in the current converter W is interrupted, and after a few hundred milliseconds is switched on again and so forth. In this way, the interaction of the resistor 8, the inductor 6 and the current converter 4 produces a noticeable reduction in the current consumption of the light source L and thus an improvement in the degree of efficiency by approximately factor 2. One may characterize this interaction as an "inductive down converter."

The flash control device B essentially contains a microprocessor 9, which is connected to the message bus of a fire alarm system by way of an ASIC for instance and herefrom an operational voltage of 3V and all necessary alarm data, and two switches 10 for switching the light source L on and off. In the event of an alarm, the microprocessor 9 controls the two switches 10 so that the light emitting diodes 1 are for instance switched on for 20 ms and then switched off for 1.2 s for instance. The duration of the switch-on time is dependent here on the temperature as a result of the temperature dependency of the light intensity of the light emitting diodes. The switch-on time of the light-emitting diodes amounts for instance at a temperature of −20° C. to 15 ms, at a temperature of +20° to 20 ms and at a temperature of +70° to 27 ms. This means that the pulse width increases with the temperature. This temperature variation in the light intensity of the light-emitting diodes is corrected by a sensor contained in the microprocessor 9, for instance a diode (not shown). A similarly bright light distribution of the light-emitting diodes 1 is enabled between the switches 10 and the two branches with the light-emitting diodes 1 with the aid of the two resistors 1.

The possibility of controlling the light emitting diodes 1 by means of the flash control device B in certain pulse forms similarly contributes to reducing the current consumption. The pulse forms can be designed to control the light emitting diodes 1 in accordance with the degree of attention which is to be achieved. The two branches can for instance be switched on and off alternately with the light emitting diode 1 in order to suggest a moving light source L or the flashing light can flash sequentially, with a preliminary and main flash. These different possibilities of controlling the light source L are then particularly advantageous if the flashing light is mounted at locations, for instance in a long corridor, where the light emitted by the light source L does not necessarily immediately attract attention.

The described flashing light is advantageous in terms of a minimal current consumption, an improved degree of efficiency and a comparatively constant light emission over a large voltage range of 12 to 30 V. With a predetermined current consumption, it has as large an effective light intensity as possible and at locations where it is only seen at a relatively shallow angle can reliably alert anyone present there.

The invention claimed is:

1. A flashing light for an alarm system, comprising:

a light source containing at least one light-emitting diode and a circuit for controlling said light source;

said circuit including a feed supply and a flash control device; and a current converter connected in series with said light source and said flash control device;

wherein said current converter is an inductive down converter including a control unit connected in series with an inductor, an induction stop, and a resistor;

wherein said resistor, in conjunction with said control unit, is configured to maintain a current flowing to said light source constant during a duration of illumination;

wherein said flash control device includes at least one switch for actuating said light source and a microprocessor for actuating said at least one switch; and wherein said microprocessor includes a data communication connection to a message bus of the alarm system.

2. The flashing light according to claim 1, wherein said light source comprises a plurality of light-emitting diodes connected in two branches, and wherein a switch is connected in each of said two branches.

3. The flashing light according to claim 2, wherein said switch is controlled with a pulse signal have an adjustable pulse shape.

4. The flashing light according to claim 3, wherein said microprocessor is configured to control the pulse shape of the pulse signal in dependence on an ambient temperature, and wherein said microprocessor includes or is connected to a temperature sensor.

5. The flashing light according to claim 4, wherein a width of the pulse increases with increasing temperature.

6. The flashing light according to claim 2, wherein said light source is controlled by alternately switching said two branches containing said light-emitting diode on and off.

7. The flashing light according to claim 2, wherein said light source is controlled with a sequential flash emission in form of preliminary flashes and main flashes.

* * * * *